US008641272B1

(12) United States Patent
Marchetti et al.

(10) Patent No.: US 8,641,272 B1
(45) Date of Patent: Feb. 4, 2014

(54) SYSTEM FOR PERFORMING DILATOMETER TESTS ON THE SEAFLOOR

(75) Inventors: Silvano Marchetti, Roma (IT); Diego Marchetti, Roma (IT)

(73) Assignee: Diego Marchetti, Rome (IT)

( * ) Notice: Subject to any disclaimer, the term of this patent is extended or adjusted under 35 U.S.C. 154(b) by 33 days.

(21) Appl. No.: 13/567,259

(22) Filed: Aug. 6, 2012

(51) Int. Cl.
*G01N 25/16* (2006.01)

(52) U.S. Cl.
USPC ..... 374/55; 73/84; 73/866.5; 175/50

(58) Field of Classification Search
USPC ..... 374/55, 208, 141, 100, 187, 195, 198, 374/199, 6; 74/84, 81, 82, 85; 175/50
See application file for complete search history.

(56) References Cited

U.S. PATENT DOCUMENTS 4,043,186 A 8/1977 Marchetti
4,773,259 A * 9/1988 Handy ..... 73/84
6,196,333 B1 * 3/2001 Aardal ..... 175/5
7,898,903 B2 3/2011 Marchetti et al.
2010/0050764 A1 * 3/2010 Foo et al. ..... 73/170.32

* cited by examiner

*Primary Examiner* — Lisa Caputo
*Assistant Examiner* — Janice M Soto
(74) *Attorney, Agent, or Firm* — Novak Druce Connolly Bove + Quigg LLP

(57) ABSTRACT

System for performing dilatometer tests on the seafloor including a unit to rest on the seafloor, including: a pushing rod including at its lower end a dilatometer blade, and a driver device to drive the pushing rod, and cause the dilatometer blade to penetrate into the seafloor and bring the dilatometer into a plurality of predetermined test depths; the driver device including: a clamping member to clamp the pushing rod, at least a pushing member for pushing down to the seafloor the clamping member when the clamping member is clamping the pushing rod, causing the rod and dilatometer blade to penetrate into the seafloor, and for pushing up the clamping member when the clamping member is not clamping the pushing rod, wherein the pushing member moves up and down the clamping member, and moves in an intermittent way the dilatometer between a predetermined test depth and the subsequent one.

15 Claims, 2 Drawing Sheets

SYSTEM FOR PERFORMING DILATOMETER TESTS ON THE SEAFLOOR

FIELD OF THE INVENTION

Figure 1:
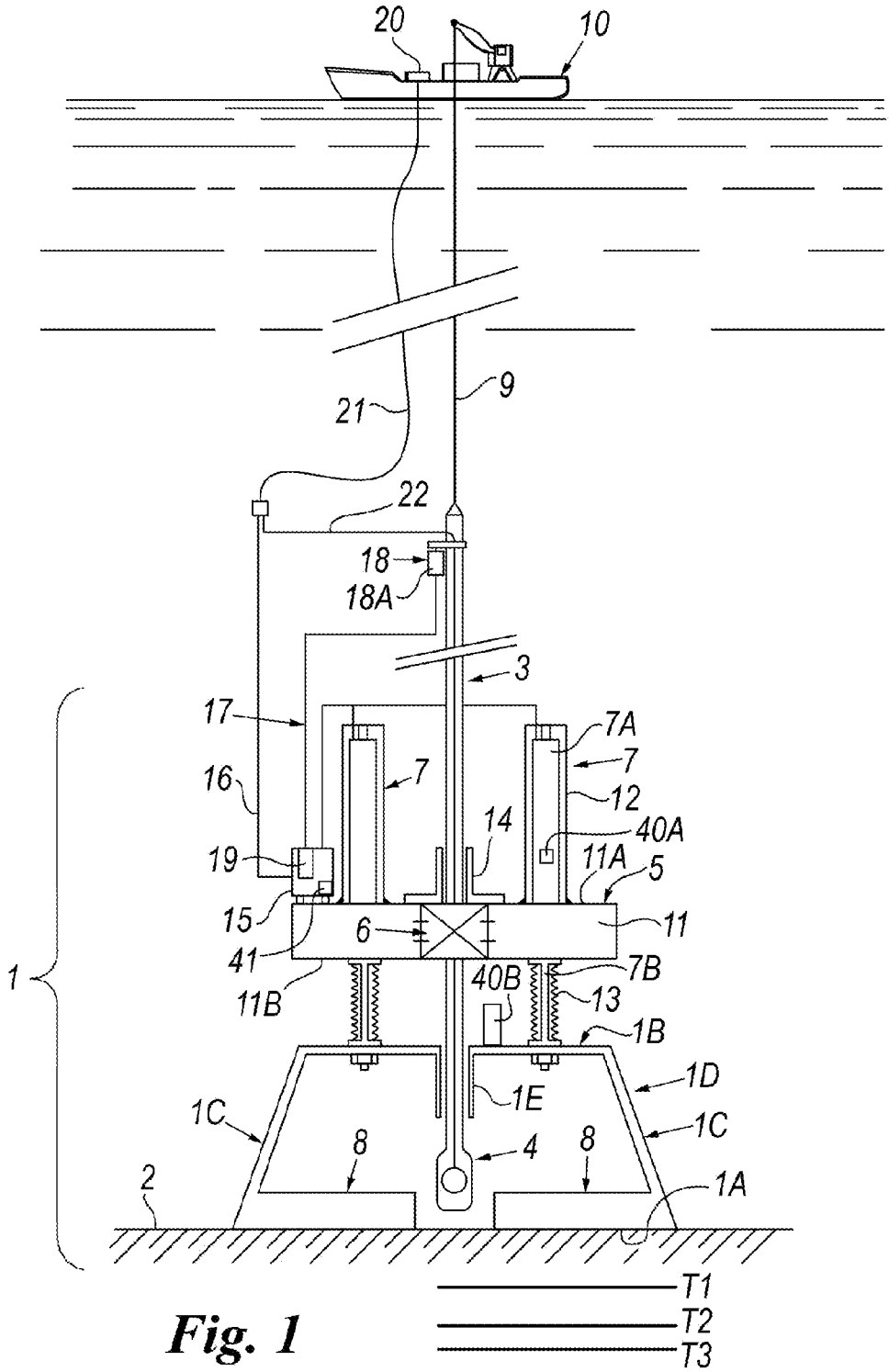

The present invention relates to a system for performing dilatometer tests on the seafloor.

In the present context by the term seafloor it is meant the bottom of a location covered by water, for an example the bottom of a sea, ocean, lake, or a pond.

STATE OF THE ART

Dilatometer tests (DT) are widely used for determining soil properties for geotechnical design, but almost uniquely on land. These tests are usually carried out by using a flat dilatometer, which is a conventional membrane instrument, in which said membrane is expandable by a pressurized gas, and which is used for measuring soil properties. Flat dilatometers of the aforeindicated type are described for example in U.S. Pat. No. 4,043,186 to Marchetti and U.S. Pat. No. 7,898,903 to Marchetti et al, the contents of both of which are incorporated herein by reference to be considered as embodied into the present specification.

These known dilatometers are mounted at the lower end of a drillstring, composed by a series of tubular steel rods, whose function is to advance the dilatometer to the required depths into the ground to be investigated. The dilatometer is connected by a plurality of cables (commonly known as "umbilical cables") housed in the tubular rods to a plurality of external devices housed outside the soil to be examined and comprising, for example a control unit, an electrical powering unit, a pressurized gas unit, and others.

The dilatometers are usually used with the following operating sequence:

s.1) the tubular rods are driven into the ground until the dilatometer reaches the first required depth;

s.2) at this depth, the dilatometer membrane is expanded by feeding gas at gradually increasing pressure, said membrane having one outer face in contact with the soil to be tested;

s.3) the control unit acquires at least two pressure values (of the compressed air and hence the reaction of the soil to be tested which opposes the membrane thrust). These pressure values represent the pressure at which the dilatometer membrane starts moving, thereby separating from a support element and the pressure at which the membrane has separated by a predetermined distance, for example 1.1 mm, from said support;

s.4) having measured at least these two pressure values, the membrane is returned to its rest condition by deflating the membrane;

s.5) the dilatometer is advanced to the next test depth and the sequence is repeated.

As of today, the use of flat dilatometers in marine investigations is still hampered by the lack of simple and economical systems for carrying out the test offshore.

In the past decades a few dilatometer offshore investigations were carried out, but always from vessels equipped with a hole on the deck. Said hole hosts a guide tube extending from the vessel to the sea bottom, with the dilatometer probe lowered down to the seafloor through said tube.

A drawback of carrying out the investigations from a vessel with a guide tube is the necessity of keeping the vessel stationary on the vertical of the investigation point, which is not easy in open sea, especially in case of rough sea. In case of significant vessel movements, the guide tube breaks and valuable equipment may go lost. Such investigations are also rather costly.

Dilatometer investigations have never been carried out from a rig resting on the sea bottom.

Pushing rigs resting on the seafloor, connected to the surface vessel by a flexible slack umbilical cable, rather than by a rigid tube, are exempt from the above mentioned risk related to the use of guide tubes extending from a vessel.

There are known seafloor rigs for pushing a conical probe of the Cone Penetration Test (CPT). The objective of the CPT is to measure the force necessary to advance the cone into the soil. The penetration must therefore be continuous and at the fixed regulation-established velocity of 2 cm/sec.

Such seafloor rigs would need costly adaptation for running dilatometer tests which are performed differently from CPT.

U.S. patent application Ser. No. 13/194,762 to Marchetti filed Jul. 29, 2011, incorporated herein by reference, discloses the use of a seafloor rig for CPT in connection with a particular type of flat dilatometer. This device is an automated deepwater cableless dilatometer which needs quite a complex and expensive control system to perform the test and for controlling its movements between a predetermined test depth and the subsequent one. This cableless dilatometer is much more expensive than conventional dilatometers.

An object of the present invention is to provide a system for performing dilatometer tests on the seafloor, which is relatively small and lightweight, and therefore simple and economical.

SUMMARY OF THE INVENTION

This and other objects, which will be apparent to an expert of the art, are attained by a system and a method in accordance with the characterising part of the accompanying claims.

In the dilatometer test the penetration has the only function of advancing the probe to the prefixed depth. Once the prefixed depth has been reached, the advancement is stopped and the dilatometer test starts. Therefore, the mode of advancing the dilatometer is not critical, in particular the mode is not subjected to the above noted constraints for CPT.

The scope of the CPT probe advancement is very different from the scope of the dilatometer probe advancement. CPT testing inherently requires a continuous penetration necessary to make the test. Dilatometer testing inherently requires stopping at a plurality of test depths to make the test. The CPT measurements occur while the CPT probe advances, while the dilatometer measurements occur when the dilatometer probe is stationary. In view of the different modes of advancement of the test probe it has been possible to realize a dilatometer system and a method according to the invention, comprising a new and more convenient way of advancement of the test probe.

In the present invention the advancement occurs in short intermittent non continuous depth increments (for example comprised between 2 cm and 10 cm), a mode of advancement that would be unacceptable for CPT.

As shown later in this document, the possibility of advancing the dilatometer in short depth increments allows to devise a seafloor dilatometer system relatively small and light, therefore simple and economical.

Another simplifying feature of the present invention is that, in water depths of the order of a few hundreds meters, it is possible to use the same electro-pneumatical cable used for inflating the dilatometer probe on land.

The advantages obtained by the present invention will be more evident to the expert of the art from the following detailed description of one embodiment thereof, provided by way of non-limiting example and illustrated with reference to the accompanying schematic figures.

LIST OF FIGURES

Figure 2:
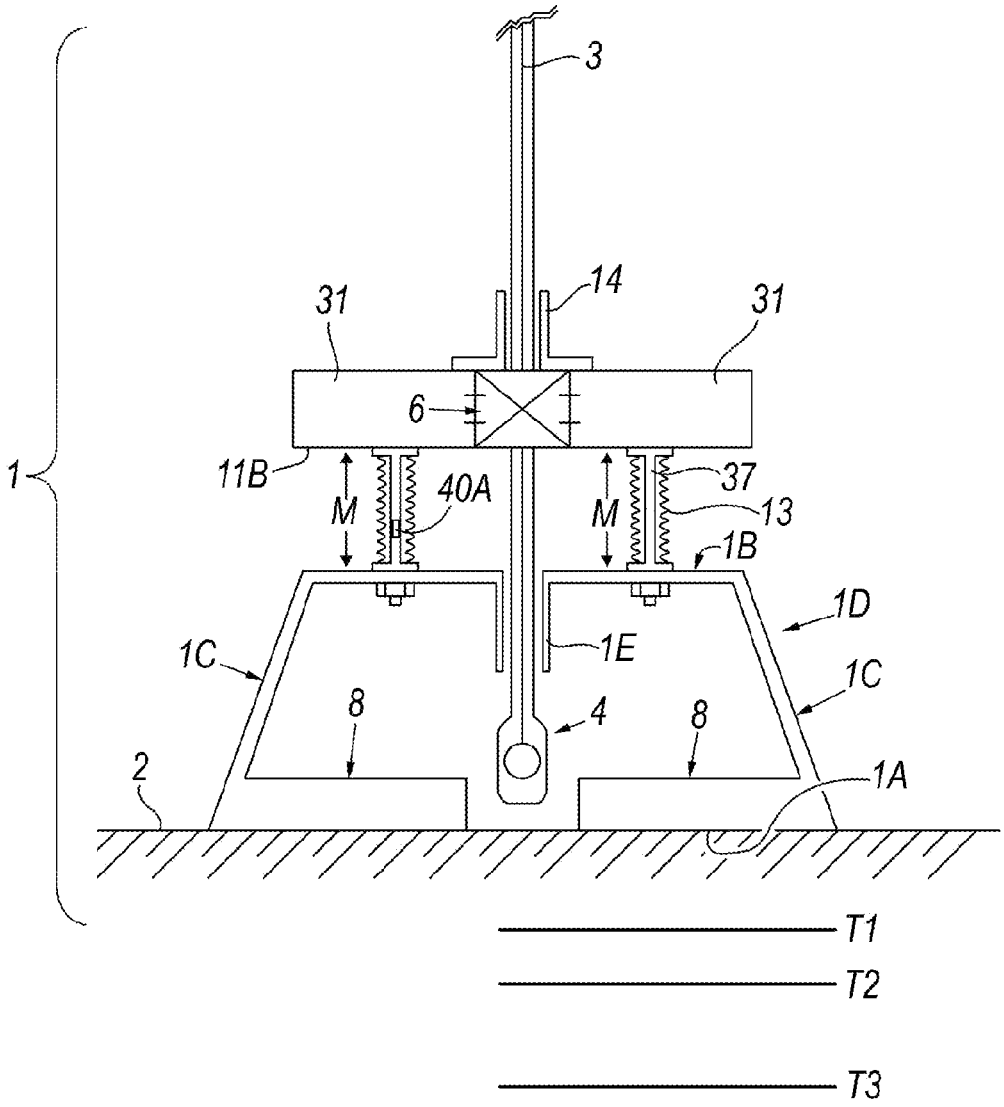

FIG. 1 is a schematic view of a system according to the invention, when it is used on a seafloor, FIG. 2 is a lateral view showing in a schematic way a variant of a part of the device for advancing the rod carrying the dilatometer,

DETAILED DESCRIPTION

The system for performing dilatometer tests on the seafloor, according to the invention, comprises a unit 1 able to rest on the seafloor 2, comprising:

- at least a pushing rod 3 comprising at its lower end a dilatometer 4,
- and a driver device 5 adapted to drive said pushing rod 3 and cause said dilatometer 4 to penetrate into the seafloor 2 and bring said dilatometer into a plurality of predetermined test depths T1, T2, T3.

According to the invention the driver device 5 comprises:

- a clamping member 6 adapted to clamp said pushing rod 3,
- and at least a pushing member 7 for pushing down to said seafloor 2 said clamping member 6 when said clamping member is clamping said pushing rod, causing said dilatometer to penetrate into the seafloor,
- and for pushing up said clamping member when said clamping member is not clamping said pushing rod, wherein said pushing member 7 cause an up and down movement of said clamping member, and a plurality of non continuous (or intermittent) movements of said dilatometer between a predetermined test depth and the subsequent one.

The unit 1 adapted to rest on the seafloor comprises a base structure 1D resting on the seafloor 2, and including a ballast 8 necessary to avoid the lifting of the system when the pushing rod is pushed into the seafloor. The base structure has preferably the form of a truncated pyramid or a cube and comprises preferably an open frame including a lower and an upper polygonal base element 1A, 1B, connected by lateral elements 1C, preferably all these elements are provided with openings which make it easier to lower the structure on the seafloor.

Preferably, the base structure comprises a central tubular guide element 1E departing from the lower face of the upper base element 1B, for guiding the pushing rod when it is pushed down to the seafloor.

The pushing rod 3 is a conventional drill string for soil investigations, composed by a series of tubular modular steel rods connected together. For example the tubular pushing rod 3 may comprise a plurality (5 or 6 or 7) of tubular rods having a height of about 1 m and having an outer diameter of about 36 mm, and connected together in a conventional way. The pushing rod 3 carries at its lower end a conventional dilatometer 4, preferably a dilatometer blade, and at its top end it is connected to a steel rope 9, whose upper end is in a boat 10 or in any other type of vessel or floating structure able to rest on the water.

The driver device 5 comprises a connecting element 11 carrying the pushing members 7 and the clamp 6.

The pushing members imposing the up and down movement to the clamp can be of different types, among which oleodinamic/pneumatic jacks and electromechanical linear actuators are preferable. These pushing members comprise a main body 7A and a stem 7B connected, for example bolted, to the upper base element 1B of the structure 1D. The pushing member main bodies 7A are each housed in a water proof protecting tubular body 12 and the stems 7B are each housed in a water proof bellow, such as an elastic sleeve 13. The open end of the tubular bodies 12 are connected in an usual water proof way to an upper base 11A of the connecting element 11. The open ends of the elastic sleeves 13 are connected in an usual water proof way to the upper base 1B of the base structure 1 resting on the seafloor and to a lower base 11B of the connecting element 11. As an alternative to the bellow like sleeves, water proof sliding flanged telescopic tubes can be used.

Preferably, there are provided more than one pushing member 7 and these pushing members are preferably uniformly spaced with respect to each other and to the center of the connecting element 11.

Preferably the pushing members are able to exert on the clamp a total pushing force comprised between 1 and 10 tons.

The clamp 6 is provided in the centre of the connecting element 11. The clamp is a conventional unidirectional clamp of the type usually used in the soil drilling industry in connection with a drill string. This clamp may be of the type comprising wedges or spheres as the clamping elements. Suitable clamps are available from suppliers of drilling tools. The clamping member 6 according to the invention is rigidly fixed to the connecting element 11 and comprises a clamping hole into which a portion of the pushing rod 3 is inserted. The one directional clamping member 6 is mounted in such a way that it may:

- freely slide on the pushing rod 3 when the clamp moves upwards,
- and rigidly engage the pushing rod 3, and therefore pushing it, when the clamp moves downwards.

The connecting element 11 comprises a tubular guide element 14 for the pushing rod, centrally connected to the upper face 11A of the connecting element.

This tubular guide element 14, in cooperation with the other tubular guide element 1E of the base structure 1, ensures that the pushing rod 3 moves down to the seafloor without blocks even if one of the pushing members is not working, or the pushing actions of the pushing members are not uniform.

The connecting element 11 comprises a base control unit or device 15 connected with a cable 16 to a main control unit 20 provided on the boat 10. The base control unit 15 is also connected by a cable 17 to a depth detecting element 18 which is adapted to generate a signal corresponding to the movement of the pushing rod 3. Preferably this detecting element 18 comprises a closed partially full container 18A, rigidly attached to the top of the rods, connected by a cable 17, which is a liquid-filled tube, to a conventional pressure transducer 19 provided inside the base control unit 15. As the pressure on the transducer 19 decreases as the rod 3 descends, the transducer is able to generate an electrical signal corresponding to the movement of said rod.

The base control unit 15 also comprises a switch device 41 for automatically inverting the movement direction of the pushing elements when they reach a predetermined end position. For example, when the pushing element has moved the clamp 6 for about 4 cm.

Preferably, this switch device 41 comprises a conventional limit switch 40A, 40B provided on the pushing members 7 or on the upper face of the upper base element 1B. Thanks to this switch device it is possible to regulate the up and down movements of the clamp to a preferred value.

The system preferably also comprises a conventional umbilical cable 21 connecting the boat 10 and its main control unit 20 to the unit 1 of the system resting on the sea floor. The umbilical cable 21 includes a plurality of electrical cables grouped in the cable 16 entering the control unit 15 and a conventional electro-pneumatic cable 22 passing inside the pushing rod 3 and connected to the dilatometer.

The electrical cable 16 comprises a conventional electrical power line to energize the pushing members 7 and conventional communication cables, at least one of which transmits to the main control unit 20 on the boat the output signal of the pressure transducer 19, i.e. the position of the pushing rod 3.

According to the invention the unit 1 adapted to rest on the seafloor, suspended to the steel rope 9, is lowered down to the seafloor 2 together with the umbilical cable 21. The length of the steel cable 9 and of the umbilical cable 21 are preferably kept in excess of the water depth, so that movements of the boat are not transmitted to the unit on the bottom.

An operator on the boat 10 acting on the main control unit 20 switches on the electrical power to the unit 1, so that the pushing members 7 initiate their up-and-down movement, thereby advancing the pushing rod 3 and the dilatometer blade 4 in the sea floor. As the rod 3 advance, the pressure exerted by the liquid in the half full container 18A and through the tube 17 on the pressure transducer 19 contained in the base control unit 15 increases. The signal of the transducer 19 is transmitted to the main control unit 20 on the boat via the cables 16 and 21 and visualized on a display of the main control unit 20, so that the operator is aware of the advancement of the dilatometer 14 in the seafloor.

Preferably the pushing members (controlled by the switch device 41 of the control unit 15) are adapted to advance the pushing rod of about 2 to 10 cm for each pushing down step, more preferably each movement of the rod is of about 4 cm.

Therefore, according to the invention, the dilatometer 4 is moved into the seafloor in a non continuous or intermittent way, between a predetermined test depth and the subsequent one, with depth increments or jerks preferably of about 2 to 10 cm, and more preferably 4 cm, for each movement of the dilatometer into the seafloor.

Preferably, these non-continuous intermittent depth increments are lower than or equal to half the distance between said test depth and the subsequent one.

When the dilatometer has reached a prefixed test depth (for example T1, or T2 or T3 FIG. 1), the operator switches off the power to the pushing members 7, thereby stopping the advancement of the dilatometer blade. At this time the system is ready for the operator to perform the dilatometer test by inflating the membrane of the dilatometer probe 14 (via the cables 21 and 22) and take the measurements signal transmitted (via the cables 21 and 22).

When the dilatometer test has been completed the operator switches the power on to further advance the rod and the dilatometer, and the sequence is repeated.

The above manual way of controlling the system and performing the test may be easily be implemented at least partially in a software running in a conventional automatic control device which will not be disclosed in detail as they are conventional for the expert in the field.

According to the invention the pushing members 7 may impose to the clamp 6 an up and down movement also in a different way as that described above. As schematically disclosed in FIG. 2 a weight 31, rigidly connected to the clamp 6, is first lifted up to a prefixed end position by pushing members 37. When the weight 31 has reached this end position, the pushing members 37 are retracted and the weight becomes applied—via the clamp—to the rod 3 and the dilatometer 4, which consequently moves downwards into the seafloor. According to this embodiment the pushing members 37 move up and down as disclosed in FIG. 2 by arrows M.

The system described till now may be used for water depths up to 200 m because for deeper depths the electro-pneumatical cable 21, would not be usable any more due to the excessive pressure drop along the long cable.

However, the unit 1 disclosed above may still be used also at depths deeper then 200 m by using an automated deep water cableless dilatometer that avoids the need of an electro pneumatical cable, and with a system similar to that disclosed before but with pushing members connected to a power source provided on the unit resting on the seafloor, and a control system, also provided on said unit, able to synchronize the movement of the pushing rod with the dilatometer tests. A detailed description of this cableless dilatometer and of the control system is disclosed in the already mentioned U.S. patent application Ser. No. 13/194,762 to Marchetti, filed Jul. 29, 2011 the contents of which are incorporated by reference to be considered as embodied into the present specification.

The invention claimed is:

1. A system for performing dilatometer tests on the seafloor comprising a unit able to rest on the seafloor, comprising:

at least a pushing rod comprising at its lower end a dilatometer, and a driver device adapted to drive said pushing rod, and cause said dilatometer to penetrate into the seafloor and bring said dilatometer into a plurality of predetermined test depths, said driver device comprising:

a clamping member adapted to clamp said pushing rod, and at least a pushing member for pushing down to said seafloor said clamping member when said clamping member is clamping said pushing rod, causing said rod and the dilatometer to penetrate into the seafloor, and for pushing up said clamping member when said clamping member is not clamping said pushing rod, wherein said pushing member moves up and down said clamping member and moves in an intermittent non continuous way said dilatometer between a predetermined test depth and the subsequent one, and wherein said pushing member is housed in a water proof element.

2. A system according to claim 1, wherein said unit able to rest on the seafloor includes a base control unit comprising a switch device for automatically inverting the direction of movement of the pushing member, when said clamp reaches a predetermined upper and lower end position.

3. A system according to claim 1, wherein said driver device moves said dilatometer between a predetermined test depth and the subsequent one with a plurality of depth increments, each increment being minor than half the distance between said test depth and the subsequent one.

4. A system according to claim 1, wherein the at least one pushing member is a linear actuator.

5. A system according to claim 1, wherein the clamp is a one directional clamp.

6. A system according to claim 1, wherein the unit adapted to rest on the sea floor comprises a base structure resting on the seafloor, and a connecting element supporting the pushing member and the clamp and connected to said base structure.

7. A system according to claim 1, wherein the unit adapted to rest on the seafloor comprises at least one central tubular guide element for guiding the pushing rod when it is pushed down to the seafloor.

8. A system according to claim 1, wherein the pushing rod comprises a plurality of tubular modular steel rods connected together.

9. A system according to claim 1, comprising an umbilical cable connecting a boat and the unit resting on the sea floor, said umbilical cable including a plurality of electrical cables and a electro-pneumatic cable connected to the dilatometer.

10. A system according to claim 1, wherein the pushing member comprises a main body provided on a connecting element and a stem connecting said connecting element to a base structure adapted to rest on the seafloor.

11. A system according to claim 1, wherein the pushing member comprises a main body and a stem, said main body being housed in a water proof protecting tubular body and said stem being housed in a water proof elastic sleeve.

12. A method for examining seafloors using a system in accordance with claim 1, comprising a step in which a dilatometer is made to advance into the seafloor to depths at which the measurements are to be carried out, wherein the advancement of the dilatometer between a predetermined test depth and the subsequent one comprises a plurality of intermittent non continuous movements of said dilatometer.

13. A method according to claim 12, wherein the dilatometer is made to advance into the seafloor between a predetermined test depth and the subsequent one in a non continuous way with a plurality of depth increments, each increment being lower than or equal to half the distance between said predetermined test depth and the subsequent one.

14. A method according to claim 12, wherein the dilatometer is made to advance into the seafloor between a predetermined test depth and the subsequent one in a non continuous way with a plurality of depth increments, each increment being lower than or equal to half the distance between said predetermined test depth and the subsequent one, wherein all said depth increments have the same length.

15. A method according to claim 12, wherein the dilatometer is made to advance into the seafloor between a predetermined test depth and the subsequent one in a non continuous way with a plurality of depth increments, each increment being comprised between 2 cm and 10 cm.

* * * * *